US006179260B1

(12) United States Patent
Ohanian

(10) Patent No.: US 6,179,260 B1
(45) Date of Patent: Jan. 30, 2001

(54) DEVICE FOR COUPLING AN IV STAND TO A PATIENT TRANSPORT

(76) Inventor: N. Sean Ohanian, 216 Barden Rd., Bloomfield Hills, MI (US) 48304

( * ) Notice: Under 35 U.S.C. 154(b), the term of this patent shall be extended for 0 days.

(21) Appl. No.: 09/329,921

(22) Filed: Jun. 10, 1999

Related U.S. Application Data

(60) Provisional application No. 60/088,757, filed on Jun. 10, 1998.

(51) Int. Cl.[7] ..... A47B 96/06

(52) U.S. Cl. ..... 248/229.16; 5/503.1; 248/229.16; 248/229.26; 248/219.4; 403/374.1

(58) Field of Search ..... 248/229.1, 229.16, 248/229.26, 230.7, 218.4, 219.4; 5/508.1, 503.1; 403/374.1, 373

(56) References Cited

U.S. PATENT DOCUMENTS

| | | | | |
|---|---|---|---|---|
| 2,673,771 | | 3/1954 | Krewson . | |
| 2,696,963 | | 12/1954 | Shepherd . | |
| 4,489,454 | * | 12/1984 | Thompson | 5/503.1 |
| 4,511,157 | | 4/1985 | Wilt, Jr. . | |
| 4,511,158 | | 4/1985 | Varga et al. . | |
| 4,600,209 | | 7/1986 | Kerr, Jr. . | |
| 4,729,576 | | 3/1988 | Roach . | |
| 4,945,592 | | 8/1990 | Sims et al. . | |
| 5,094,418 | | 3/1992 | McBarnes, Jr. et al. . | |
| 5,135,191 | | 8/1992 | Schmuhl . | |
| 5,149,036 | | 9/1992 | Sheehan . | |
| 5,355,539 | | 10/1994 | Boettger . | |
| 5,421,548 | | 6/1995 | Bennett et al. . | |
| 5,588,166 | | 12/1996 | Burnett . | |
| 5,699,988 | | 12/1997 | Boettger et al. . | |
| 5,704,577 | | 1/1998 | Gordon . | |
| 5,898,961 | * | 5/1999 | Ambach et al. | 5/503.1 X |

* cited by examiner

*Primary Examiner*—Ramon O. Ramirez
(74) *Attorney, Agent, or Firm*—Rader, Fishman & Grauer PLLC

(57) ABSTRACT

A coupling bracket for interconnecting an IV stand with a patient transport device includes a base having an attachment portion for connecting the coupling bracket to the transport device. An extension arm laterally projects from the base and terminates at an IV stand receiver portion that receives and positively retains an IV pole. Redundant IV pole retaining features are provided to eliminate risk of unwanted separation from the coupling bracket. In addition, pivotally collapsing and telescopically collapsing brackets are disclosed for improved storage of the coupling bracket on a patient transport device. The coupling bracket allows simultaneous movement of an IV stand and a patient transport device.

13 Claims, 3 Drawing Sheets

DEVICE FOR COUPLING AN IV STAND TO A PATIENT TRANSPORT

This application claims benefit to application Ser. No. 60/088,757, filed Jun. 10, 1998.

FIELD OF THE INVENTION

The present invention is directed to a coupling device for connecting a rolling IV stand to a patient transport device, such as, a bed, gurney or wheelchair.

BACKGROUND OF THE INVENTION

Hospital patients are frequently transferred from one area of a hospital to a different area. To perform that transfer, a patient is placed on a gurney or wheelchair and a medical assistant pushes the patient to a desired destination. Frequently, a patient receives intravenous fluids from an IV assembly. The IV assembly can include a rolling IV stand having a vertical pole with one or more IV bags and drip lines leading to the patient. Transferring the IV assembly along with the patient has presented a number of challenges. For example, a second medical assistant is sometimes used to push the IV assembly at the same pace as the gurney. A different patient transfer approach involves turning off each IV and moving each of the IV bags from the support stand to a second stand attached to the gurney. However, turning off an IV for critical care patients greatly increases the risks to their health. In addition, there is a risk that a busy medical assistant may forget to turn an IV back on or establish an improper drip rate. Also, whenever IV bags are handled, there is a risk that a bag may be dropped and potentially explode. In the case of some critical care patients, there can be five or more IV lines connected to a patient. These multiple lines can easily become entangled and crossed when patients are transferred from a gurney to a table or a bed, and vice versa. Moreover, infusion pumps are often clamped to the IV pole and need to be turned on and off and properly transferred from one pole to another, which further complicates patient transfers.

The increased labor requirements for transferring IV bags from one IV pole to another IV pole and/or independently moving an IV pole along side a gurney greatly increases medical costs. In addition, patient safety is potentially jeopardized every time an IV assembly is transferred between poles.

Recently, connecting devices have been proposed that interconnect a gurney or wheelchair with an IV assembly. However, the known devices do not provide easy attachment and removal to a gurney or wheelchair. Nor do the known devices provide a redundant securing feature that prevents unwanted detachment of the IV pole from the connecting device.

SUMMARY OF THE INVENTION

The present invention provides a coupling device for interconnecting a rollingly supported medical stand having a pole to a patient transport device, such as a gurney, a bed or a wheelchair. The coupling device has a base that includes an attachment portion for attaching the device to the patient transport device. An extension arm is connected to the base and terminates at a pole receiver portion. The receiver portion preferably has a generally cylindrical hollow housing with a vertical slot sized to receive an IV pole on the IV medical stand. Further, an anti-rotation feature, for example, a thumb screw or a liner is optionally provided on the receiver portion to tightly retain the pole in the housing preventing pole rotation. Additionally, a locking door is provided which removably closes the slot for preventing accidental removal of a medical stand pole from the pole receiver portion. The locking door is slidably received within a pair of opposing grooves to close the slot and prevent removal of the IV pole from the housing. The slot and the opposing grooves are generally vertical for generally parallel alignment with a medical stand pole.

When the anti-rotation feature is a thumbscrew, it also provides for primary positive retention of a medical stand pole and the locking door provides secondary positive pole retention for redundantly retaining a medical stand pole to a patient transport.

A further embodiment of the present invention includes a liner attached to an inner surface of the pole receiver portion, in place of a thumb screw, to grip and retain the IV pole against rotation. A still different embodiment of the present invention provides a hinged connection between the extension arm and the base, allowing folding, pivoting motion from an extended service position to a folded storage position.

A still further embodiment of the present invention includes a telescopically collapsing extension arm that permits the receiver portion to be extended to a service position or retracted to a compact storage position.

The present invention is also directed to a coupling bracket for rigidly interconnecting a rollingly supported medical stand having a pole to a patient transport, the coupling bracket comprising a base that includes an attachment portion for attaching the coupling bracket to a patient transport. An extension arm is provided having first and second ends, the first end being connected to the base. A pole receiver portion is connected to the second end of the extension arm and includes a generally hollow housing with a slot dimensioned for receiving a medical stand pole. A fastener is located on the receiver portion for tightly engaging a medical stand pole when positioned in the housing for preventing pole rotation and unwanted removal. The fastener is preferably a thumbscrew that is located in a side of the pole receiver portion for radially engaging a medical stand pole. The extension rod can be a generally cylindrical rod and can alternatively be pivotally connected to the base for folding storage or telescoping for collapsing storage.

The coupling bracket device according to the present invention provides a rigid connection between a patient transport device and an IV stand to allow their simultaneous movement without the need for an extra medical assistant to push the IV stand. Thus, the present invention reduces the amount of labor required to move a patient from one area of a hospital to another area. Further, there is no need to transfer IV bags and infusion pumps from one IV stand to another IV stand, since a single IV stand can be readily coupled to or detached from the patient transport device. Thus, the present invention increases patient safety by eliminating the need to turn off IVs as required when transferring bags from one IV stand to another.

In addition, the coupling bracket device can be easily attached or removed from one patient transport and connected to a different patient transport. Alternatively, other embodiments of the present invention can remain attached to a same patient transport and the extension arm and receiver portion can be moved to compact storage positions so as not to interfere with movement of the patient transport device or medical personnel.

Accordingly, the present invention reduces the labor required to move patients and thereby reduces medical costs for treating those patients Patient safety is also greatly increased. Moreover, the coupling bracket of the present invention enables easy installation and removal from a patient transfer device as well as compact storage. Further, a redundant securing system ensures that an IV pole will not be inadvertently separated from the bracket.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
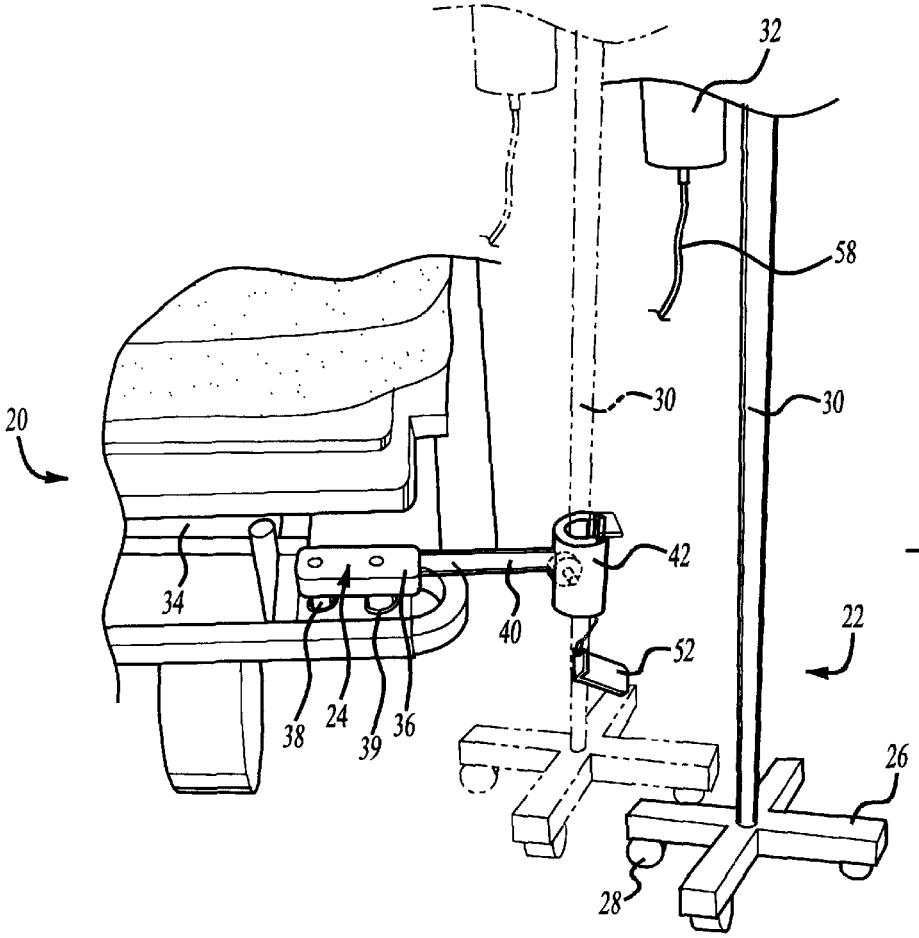
FIG. 1 shows a coupling device according to the present invention being connected to an IV stand.

FIG. 1 shows a patient transport device 20 selectively connected to a free standing IV stand 22 by a coupling bracket 24. IV stand 22 includes a base 26 with wheels or casters 28 and a vertical pole 30 having a predetermined diameter. One or more IV bags 32 hang from a uppermost part of IV stand 22. An infusion pump (not shown) is optionally attached to IV stand 22 for controlling IV fluid distribution. Patient transport device 20 is illustrated in the form of a corner portion 34 of a gurney. However, the present invention is suitable for any type of transport devices including, for example, a bed or a wheelchair. Coupling bracket 24 has a base 36 having an attachment portion 38 that engages with cooperating features 39 on transport device 20 to releasably retain coupling bracket 24 on transport device 20. An extension arm 40 projects laterally from base 36 and terminates at a receiver portion 42. IV stand 22 is selectively retained within the receiver portion to allow simultaneous movement of IV stand 22 with transport device 20.

Figure 2:
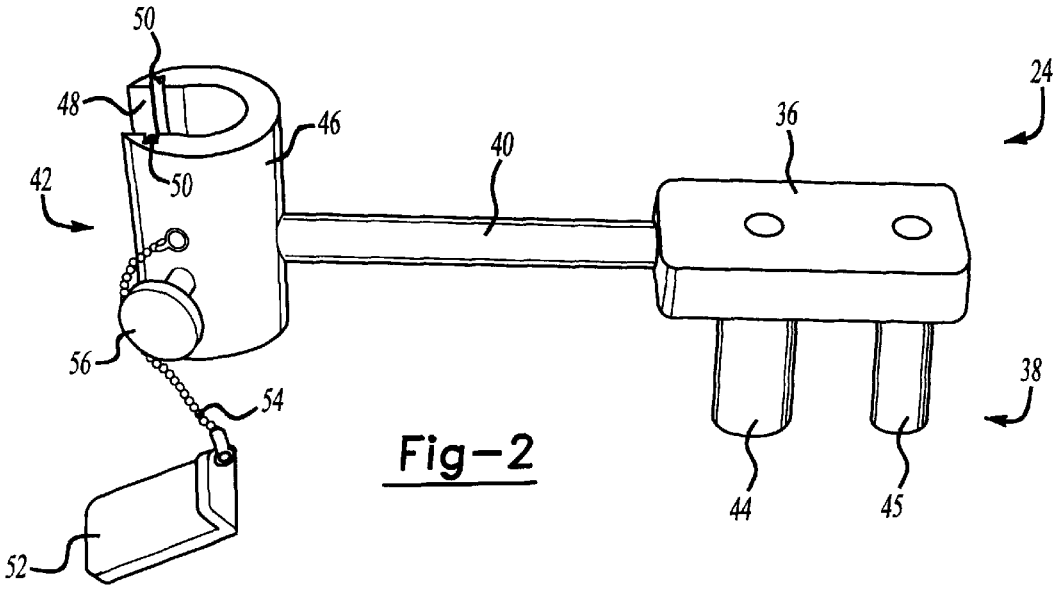
FIG. 2 is a perspective view of the IV coupling device of FIG. 1.

FIG. 2 shows further details of coupling bracket 24. Attachment portion 38 includes first and second downwardly projecting pins 44, 45 that are sized and shaped to matingly engage cooperating features 39 on transport device 20. Two pins are preferably provided to eliminate pivoting motion that would otherwise occur with a single pin. Receiver portion 42 has a generally cylindrical hollow housing 46 that includes a vertical slot 48 that permits selective insertion and removal of IV pole 30 from housing 46. Optionally, but preferably, a pair of vertically opposed grooves 50 are provided adjacent slot 48 to releasably receive a locking door 52 that closes slot 48. Thus, locking door 52 prevents unwanted removal of IV pole 30 from housing 46. Preferably, door 52 has an L-shaped cross section to allow easy grasping of door 52 by medical personnel. A chain 54 permanently attaches door 52 to housing 46 to prevent its loss when not in use. In addition, a thumb screw 56 is optionally provided to tightly hold IV pole 30 within housing 46 and prevent undesired rotation of IV stand 22 during transit. Without thumb screw 56, IV stand 22 may tend to rotate during transit and could twist or tangle IV lines 58 leading to a patient.

When it is desired to couple IV stand 22 with patient transport device 20, locking door 52 is removed from grooves 50 and thumb screw 56 is turned to a loosened position. IV stand 22 is then rolled toward receiver portion 42 and IV pole 30 is inserted through slot 48 into housing 46. Locking door 52 is then inserted into grooves 50 and thumb screw 56 is tightened against pole 30.

As described above, thumb screw 56 provides a first locking feature for pole 30 preventing its undesired rotation as well as movement out of housing 46. Locking door 52 provides a redundant positive locking feature that eliminates the risk of unwanted decoupling should thumb screw 56 loosen.

Figure 3:
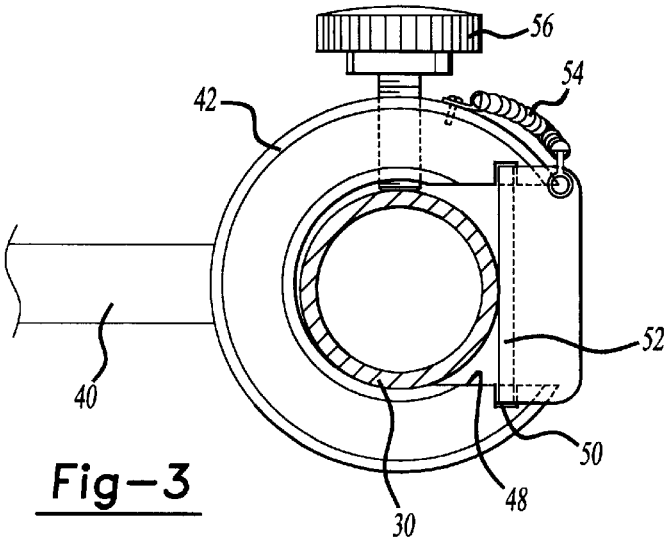
FIG. 3 is a partial top view of an IV pole retained by the coupling device.

FIG. 3 shows a partial top view of receiver portion 42 including thumb screw 56 engaging IV pole 30 to securely hold it in position. In addition, locking door 52 is shown located in grooves 50 and blocking removal of pole 30 by closing slot 48.

Figure 4:
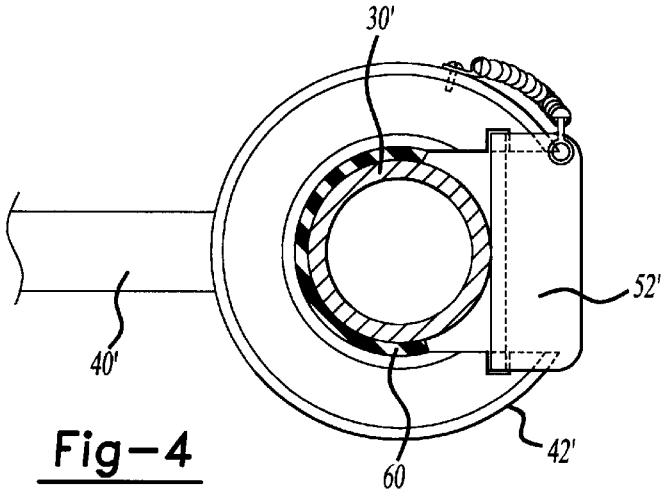
FIG. 4 is a partial top view of a coupling device according to another embodiment of the present invention.

FIG. 4 shows a different receiver portion 42' according to the present invention. In this embodiment thumb screw 56 has been replaced by a liner 60 that contacts an outer surface of pole 30' to prevent its rotation. Liner 60 is preferably made of rubber to resiliently grip pole 30' and eliminate rotation. However, any suitable material can be used. Locking door 52' prevents removal of pole 30' from housing 46'.

Figure 5:
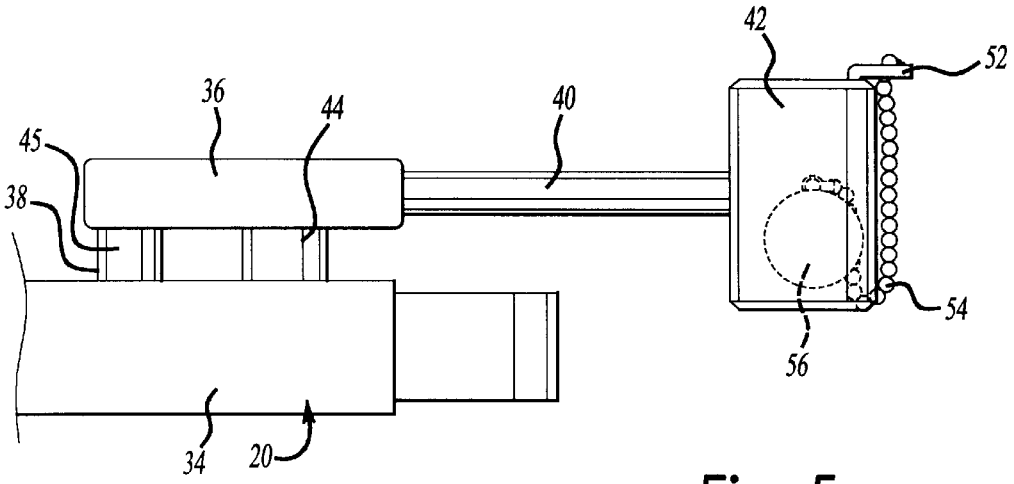
FIG. 5 shows a coupling device attached to a patient transport.

FIG. 5 shows a side view of coupling bracket 24 attached to corner portion 34 of patient transport device 20. Attachment portion 38 has first and second downwardly projecting pins 44, 45 inserted into cooperating features 39, in the form of mating apertures (not shown) to provide rigid non-pivoting connection between coupling bracket 24 and transport device 20.

Figure 6:
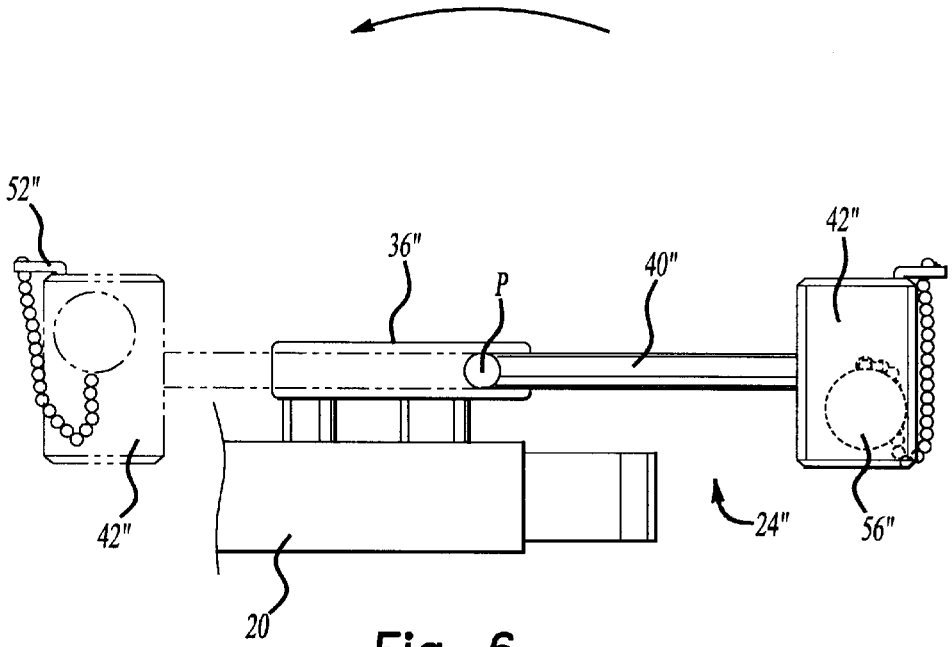
FIG. 6 shows a coupling device according to another embodiment of the present invention.

A further embodiment of the present invention is illustrated in FIG. 6. In this embodiment, extension arm 40" is pivotally attached to base 36" to allow pivoting movement of receiver portion 42" about a horizontal pivot axis P. The embodiment of FIG. 6 allows pivoting or folding of extension arm 40" and receiver portion 42" from a service position, illustrated in solid lines, to a stored position, shown in phantom. In the stored position, coupling bracket 24" does not interfere with movement or extend beyond the periphery of transport device 20. Locking door 52" can be inserted into grooves (not shown) from either direction, so locking door 52" can be stored securely after arm 40" is pivoted.

The folding coupling bracket 24" provides a more compact storage design that allows coupling bracket 24" to remain on patient transport device 20 full-time without being an unwanted projection when not in service.

Figure 7:
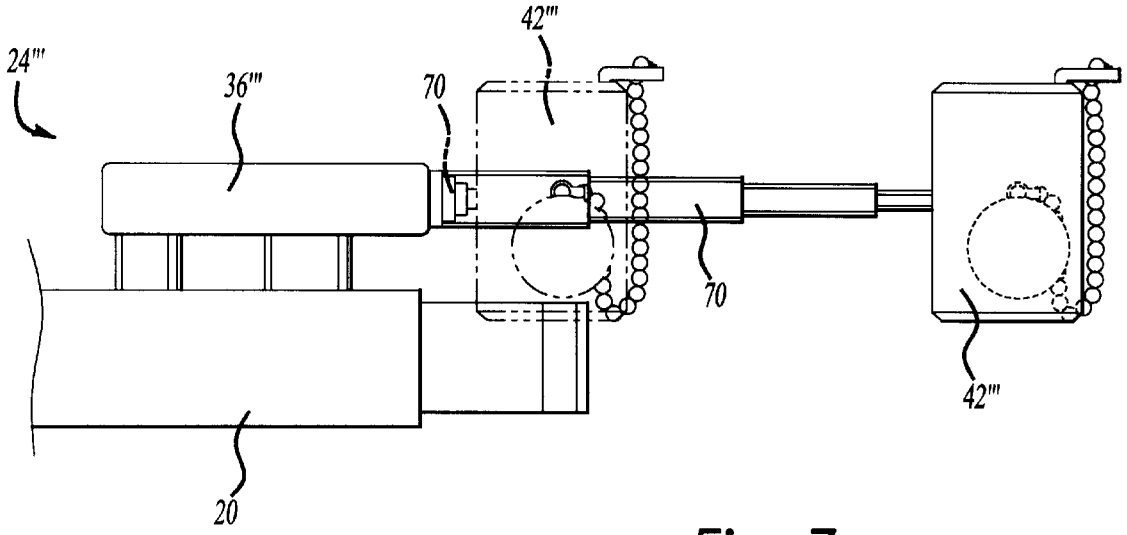
FIG. 7 shows a coupling device according to yet a further embodiment of the present invention.

A third embodiment of the present invention is shown in FIG. 7. Coupling bracket 24'" has a telescopically collapsible extension arm 70 that allows selective extension and retraction of receiver portion 42'" from an extended position shown in solid lines to a retracted position shown in phantom. Telescopic movement provides quick and easy positioning of receiver portion 42'". Although not shown, any suitable locking arrangement can be provided to maintain extension arm 70 in the extended and retracted positions. For example, spring loaded detents can be used for temporarily maintaining extension arm 70 in the extended and retracted positions, or any intermediate position in between.

Preferred embodiments of the present invention have been disclosed. A person of ordinary skill in the art would realize, however, that certain modifications would come within the teachings of this invention. For example, coupling bracket 24 is preferably made of metal to provide sufficient strength and resistance to bacteria. However, any suitable material can be used. Moreover, attachment portion 38 is illustrated having first and second pins 44, 45, however any suitable fastening arrangement can be used, either releasable or permanent. Therefore, the following claims should be studied to determine the true scope and content of the invention.

What is claimed is:

1. A coupling device for interconnecting a rollingly supported medical stand having a pole to a patient transport, the coupling device comprising:

a base having an attachment portion for attaching the device to a patient transport;

an extension arm connected to the base and terminating at a pole receiver portion for selectively engaging a medical stand pole;

said pole receiver portion having a generally hollow housing including a slot dimensioned for receiving a medical stand pole;

an anti-rotation feature for preventing unwanted rotation of a medical stand pole while positioned in the pole receiver portion; and a locking door that removably closes the slot for preventing accidental removal of a medical stand pole from the pole receiver portion.

2. The coupling device of claim 1, wherein said anti-rotation feature is a thumbscrew and said thumbscrew also provides for primary positive retention of a medical stand pole and said locking door provides secondary positive pole retention for redundantly retaining a medical stand pole to a patient transport.

3. The coupling device of claim 1, wherein said anti-rotation features is a liner attached to an inner surface of said generally hollow housing of said pole receiver portion.

4. The coupling device of claim 1, wherein said receiver portion includes a pair of opposing grooves and said locking door is slidably received within said opposing grooves to close said slot.

5. The coupling device of claim 4, wherein said slot and said opposing grooves are generally vertical for generally parallel alignment with a medical stand pole.

6. The coupling device of claim 1, wherein said locking door has a generally L-shaped cross-section to allow easier grasping of said locking door.

7. The coupling device of claim 1, wherein said attachment portion of said base includes first and second downwardly projecting pins for positively engaging a patient transport in a rigid, non-pivoting manner.

8. The coupling device of claim 1, wherein said extension arm is pivotally connected to said base to allow folding of said extension arm and said receiver portion from a service position to a storage position.

9. The coupling device of claim 1, wherein said extension arm is a rod having first end connected to said base and a second end connected to said pole receiver portion.

10. The coupling device of claim 1, wherein said extension arm is telescopically collapsible for permitting selective extension and retraction of said pole receiver portion.

11. A coupling bracket for rigidly interconnecting a rollingly supported medical stand having a pole to a patient transport, the coupling bracket comprising:

a base having first and second downwardly projecting pins for positively engaging a patient transport in a rigid, non-pivoting manner;

an extension arm having first and second ends, said first end being connected to said base;

a pole receiver housing connected to said second end of said extension arm and having a generally hollow cylindrical shape;

a slot provided in said pole receiver housing and dimensioned for receiving a medical stand pole;

a pair of opposing grooves on said receiver portion located adjacent said slot;

a thumbscrew located in a side of said receiver portion for radially engaging a medical stand pole when positioned in the housing for preventing pole rotation and unwanted removal; and a locking door slidably received within said pair of opposing grooves for selectively closing the slot and redundantly preventing removal of a medical stand pole.

12. A coupling bracket for rigidly interconnecting a rollingly supported medical stand having a pole to a patient transport, the coupling bracket comprising:

a base that includes an attachment portion for attaching said coupling bracket to a patient transport;

an extension arm having first and second ends, said first end being connected to said base;

a pole receiver portion connected to said second end of said extension arm and including a generally hollow housing with a slot dimensioned for receiving a medical stand pole;

a fastener located on said receiver portion for tightly engaging a medical stand pole when positioned in the housing for preventing pole rotation and unwanted removal; and a locking door that is slidably received within a pair of opposing grooves on said receiver portion for selectively closing said slot and redundantly preventing removal of a medical stand pole.

13. The coupling bracket of claim 12, wherein said locking door has a generally L-shaped cross-section to allow easier grasping of said locking door.

* * * * *